US005307533A

United States Patent [19]

Parramore

[11] Patent Number: 5,307,533

[45] Date of Patent: May 3, 1994

[54] MODULAR BRIDGES

[75] Inventor: Thomas S. Parramore, Christchurch, Great Britain

[73] Assignee: Williams Fairey Engineering Limited, Stockport, Great Britain

[21] Appl. No.: 817,597

[22] Filed: Jan. 7, 1992

[30] Foreign Application Priority Data

Jul. 1, 1991 [GB] United Kingdom ..... 9100241.0

[51] Int. Cl.[5] ..... E01D 15/12; E04C 3/02

[52] U.S. Cl. ..... 14/2.4; 14/6

[58] Field of Search ..... 14/23, 2.4, 77.1

[56] References Cited

U.S. PATENT DOCUMENTS

| | | | |
|---|---|---|---|
| 2,556,175 | 6/1951 | Frost | 14/2.4 |
| 4,521,932 | 6/1985 | Parramore | 14/2.5 |
| 4,663,793 | 5/1987 | Parramore | 14/2.5 |
| 4,665,577 | 5/1987 | Parramore | 14/2.5 |
| 4,920,595 | 5/1990 | Füssinger | 14/2.4 |
| 4,962,556 | 10/1990 | Helmke et al. | 14/2.4 |
| 5,042,102 | 8/1991 | Kahmann et al. | 14/2.5 X |
| 5,103,523 | 4/1992 | Drago et al. | 14/2.4 |

*Primary Examiner*—Kenneth J. Dorner
*Assistant Examiner*—Nancy Mulcare
*Attorney, Agent, or Firm*—Price, Heneveld, Cooper, DeWitt & Litton

[57] ABSTRACT

A bridge module for a modular bridge comprises a central deck structure (10), to the lateral edges of which are pivoted first and second main girder structures (12,14). These main girder structures can be pivoted from a use position, in which they define lateral deck surfaces (20,22) (which can carry a military vehicle such as a tank) to a storage position in which they are folded beneath the central deck structure (10). In the storage position, the main girder structures intermesh, one with the other, so enabling the bridge module to be packed for transport into a standard ISO container.

18 Claims, 8 Drawing Sheets

MODULAR BRIDGES

BACKGROUND OF THE INVENTION

The present invention relates to a modular bridge, particularly although not exclusively for military use. It also relates to a module for use in such a bridge.

A typical modular bridge comprises a plurality of like modules which can be transported separately to the place they are needed and then linked together on site. The modules forming the central section of the bridge generally have parallel upper and lower chords, the upper chord comprising or bearing a surface for carrying traffic, and the lower chord being arranged to withstand the tension load resulting from the dead weight of the bridge plus the weight of the vehicles passing over the bridge. At each end of the bridge there are special ramped end modules to enable vehicles to drive onto and off of the bridge.

With the increasing use of containerisation in recent years, it has become more and more desirable for the individual bridge modules to be of such a size that they can be transported in standard ISO containers. To this end, foldable modules have been developed which consist of a central deck structure having, at either side, foldable main girder structures which in use will bear the loads to be applied to the bridge. The main girder structures are hinged to the edges of the central deck structure so that they can be pivoted between a use position in which they form lateral extensions of the central deck structure, and a folded position in which they are rotated through about 90° to tuck neatly beneath the central deck structure for transport.

In this way, a module having a four meter wide roadway (that is, the width of the central deck structure plus the width of the two lateral extensions formed by the main girder structures in use) will fold longitudinally into a compact envelope not exceeding eight feet in width and four feet in height. Thus, two modules may be stacked on top of each other on a flat rack or pallet within the dimensions of a standard ISO container.

A difficulty with this arrangement is that it limits the depth of the main girder structures, and thus the load bearing capacity of the bridge. When the main girder structures have been folded inwardly through 90°, they must of course fit within the eight feet envelope of the ISO container, so that the depth of each girder cannot be greater than four feet. For bridge spans of greater than one hundred feet (thirty two meters) for a sixty tonne vehicle load, the structural efficiency of the girders will be severely limited unless the depth can be increased. This puts a fundamental limit on the span that a bridge of this type can have for a given load; or, to put it another way, it limits the load that the bridge can carry for a given span.

SUMMARY OF THE INVENTION

It is an object of the present invention to provide a bridge module which may be transported in a standard ISO container, and which at least alleviates these problems.

It is a further object to provide a folding bridge module having greater girder depth, while still being transportable within a standard ISO container. Since the modulus for bending of a girder increases as the square of its depth, an increase in the girder depth must greatly improve the potential and efficiency of the bridge design.

According to the present invention a bridge module comprises a central support and first and second lateral girder structures respectively mounted to the support for movement between a use position in which the girder structures provide respective deck surfaces laterally of the support, and a storage position beneath the support, characterised in that the lateral girder structures in the storage position at least partially overlap when viewed in a direction perpendicular to the plane of the deck surfaces in the use position.

In this way, the overall width of the bridge module in the storage position may be less than twice the height of the lateral girder structures. In the storage position, either one girder structure could overlie the other, or alternatively the structures could be shaped so that one nests or meshes within the other.

In a convenient embodiment, the first and second lateral girder structures are pivoted to lateral sides of the central support so that they can be rotated between the use and the storage position. In the storage position, then, the girder structures lie adjacent to each other and to the central support, desirably generally parallel to each other and to the plane of the support.

Differential damping means may be provided whereby, on actuation of the bridge to its use position, or recovery to its storage position, one of the girder structures always leads the other. If both of the girder structures were to move at exactly the same rate from the use to the storage position, they would tend to foul each other rather than moving smoothly into a position in which one overlaps the other.

These differential damping means conveniently comprise hydraulic dampers, one of which extends between the central deck structure and the first main girder structure and the other, having a different rate, extending between the central deck structure and the second main girder structure.

DETAILED DESCRIPTION OF THE PREFERRED EMBODIMENTS

A first embodiment of the present invention, in the form of a parallel bridge module, is shown in FIGS. 1 to 4. This module will in use be one of a series of like modules forming the central section of the modular bridge. To that end, the module has securing means (not shown) at each end for securing it to another like module. It is referred to in the art as a "parallel" bridge module, because its overall height in its open position is constant along its length (that is, in a direction perpendicular to the sectional plane of FIGS. 1 to 3).

Figure 1:
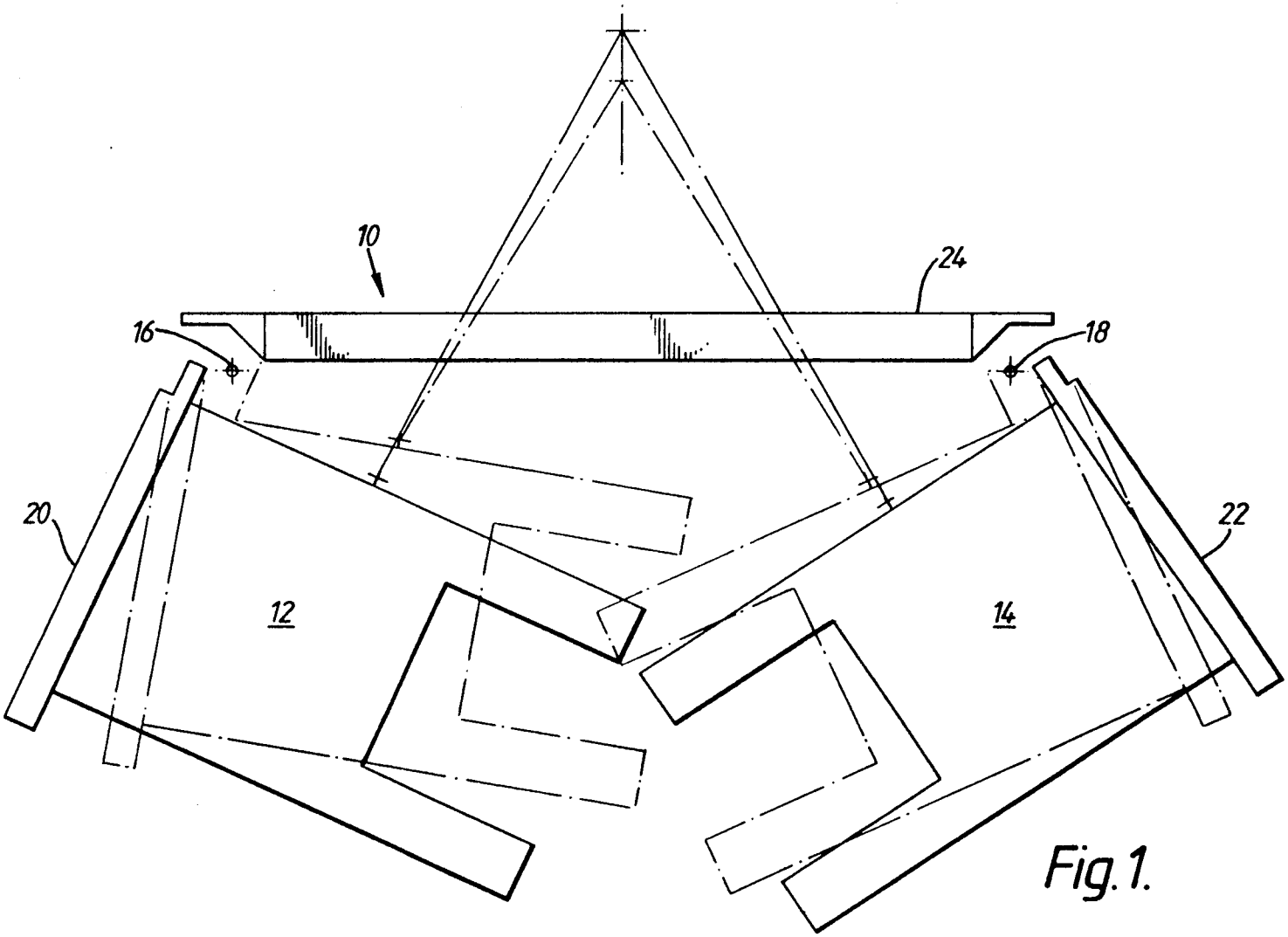
FIG. 1 is a schematic section through a parallel bridge module embodying the present invention, showing the way in which the main girder structures fold together beneath the central deck structure.

The module shown schematically in FIG. 1 comprises a central deck structure 10 at the lateral edges of which are hinged first and second lateral main girder structures 12, 14. These girder structures are respectively rotatable about pivots 16, 18 between a use position in which the upper surfaces 20,22 of the girder structures form lateral extensions of the central deck surface 24, and a folded position in which the girder structures are tucked in beneath the deck structure 10.

Figure 2:
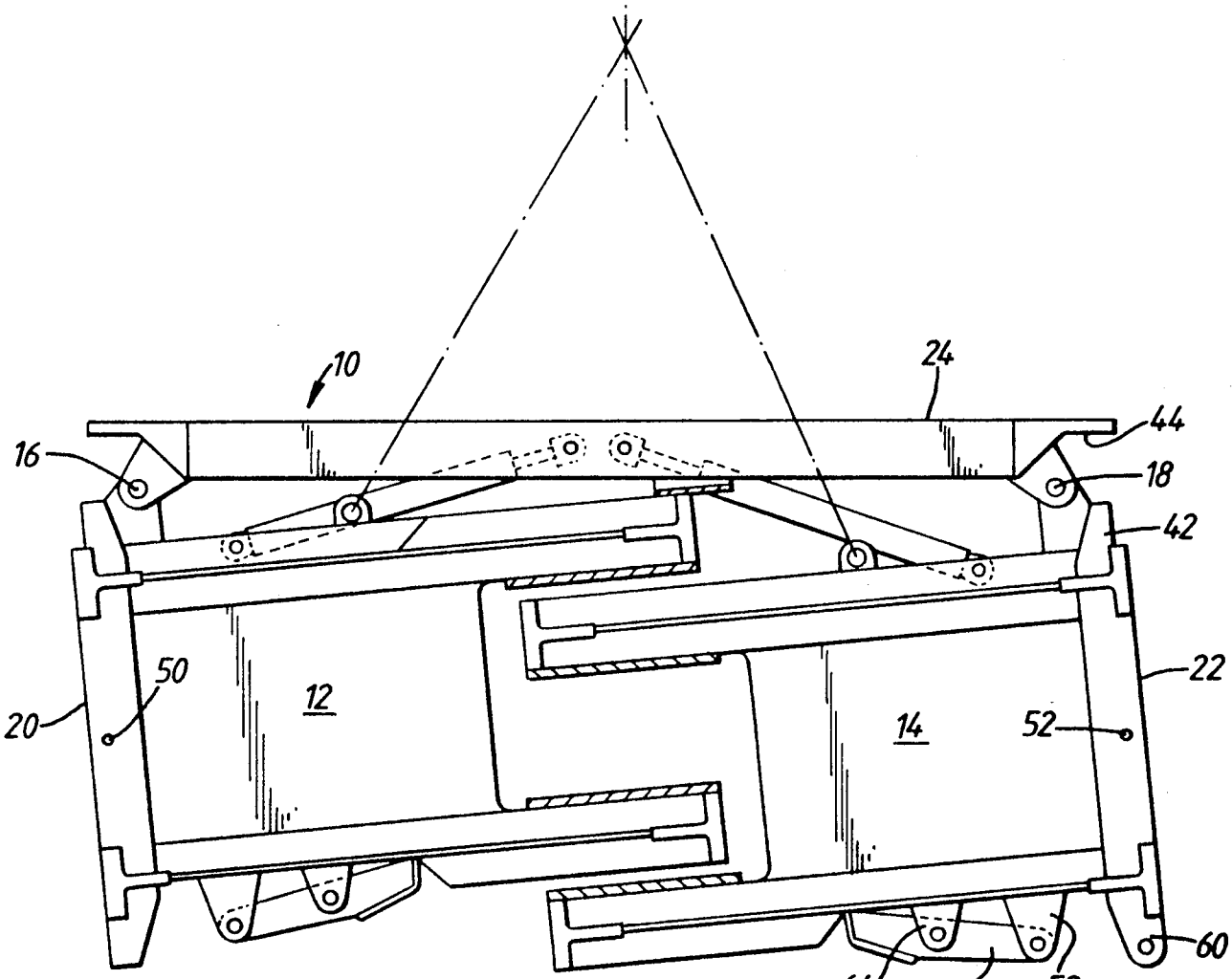
FIG. 2 is a detailed section showing the module in its folded position.
Figure 3:
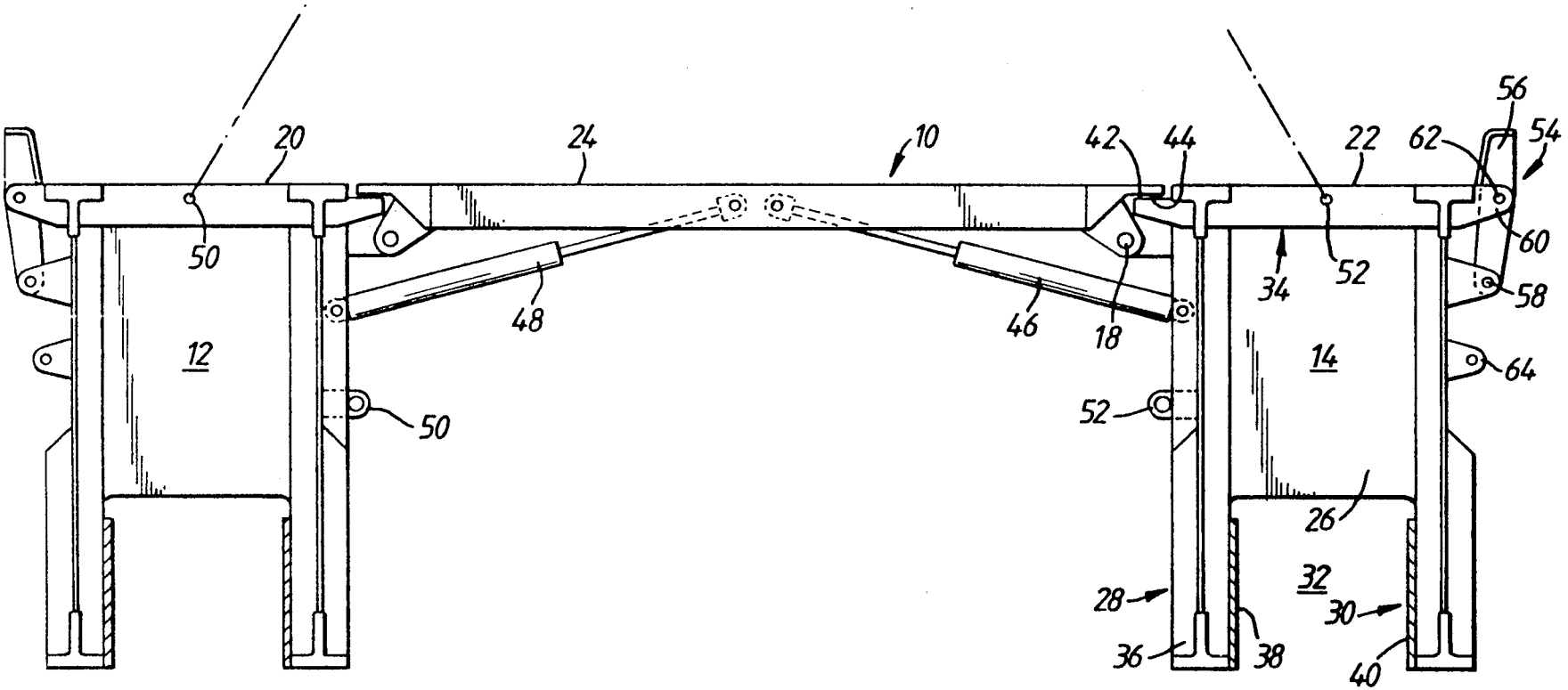
FIG. 3 is a section corresponding to that of FIG. 2 showing module in its open position.

The module in its folded position is shown in more detail in FIG. 2, and in its open position in FIG. 3.

Turning first to FIG. 3, it will be seen that the main girder structure 14 comprises an upper body portion 26, extending vertically on each side of which there are first and second supporting girders 28, 30. At their lower ends, these girders extend down below the upper body portion 26, so creating between them an elongate space 32; at their upper ends, the girders support a lateral deck structure 34 the upper surface of which defines the lateral deck surface 22.

Extending laterally from the girders 28, 30 there are web stiffeners, as indicated for example by numeral 36. At their lower ends, on either side of the space 32, the web stiffeners carry rubbing strips 38,40.

To prevent loads applied to the central deck structure 10 from being transmitted to the main girder structure 14 via the pivot 18, a shoulder 42 is provided at the upper end of the supporting girder 28 on which rests a corresponding lip 44 of the central deck structure. In FIG. 3, the shoulder 42 and the lip 44 are shown with a slight space between them, but it will be appreciated that in practice the lip will actually rest on the shoulder so that loads can be transferred.

Extending between the central deck structure 10 and the first supporting girder 28, there is a hydraulic damper 46, the purpose of which is to provide some control over the rate at which the main girder structure 14 rotates around the pivot 18.

The details of the other main girder structure 12 are essentially the same as those of the structure 14, and consequently will not be described again. The only significant difference is that the hydraulic damper 48 extending between the girder structure 12 and the central deck structure 10 is set at a different rate from that of the damper 46.

When it is desired to fold the module from the open position shown in FIG. 3 to the folded position shown in FIG. 2, retaining links (not shown) are first removed from each end of the module, and a four legged recovery sling is then secured to attachment points 50, 52 (only two of which are shown in FIGS. 2 and 3) on the respective inner supporting girders of the main girder structures. The ropes can be lifted through a transverse slot in the centre deck, and attached to a crane hook (not shown). As the sling is lifted, the main girder structures are folded inwards to the stowed position. The different orifices in the hydraulic dampers 46, 48 ensure that the structures close slightly out of phase with each other, so that the girders intermesh smoothly. The rubbing strips 38,40 prevent damage to the structure in case the girders of one structure should rub against the girders of the other. Without these rubbing strips it is not impossible that seizure could occur were one of the girders to lock against another.

In practice, each of the hydraulic dampers 46, 48 are likely to be doubled, so that in total there will be four dampers, two on each side of the module, each pair being spaced in a direction perpendicular to the plane of the section.

As will be seen from FIG. 2, the spacing between the girders 28,30 is chosen so that the structures nest closely together when one is rotated through slightly less than 90° and the other through slightly more than 90°. In the example shown, the structure 12 rotates through about 95°, and the structure 14 through about 85°.

The module may be locked in the folded position of FIG. 2 by means of retaining links (not shown).

When the module is to be deployed, a four-legged sling is secured to attachment points 50, 52 of the lateral deck structures, these attachment points being chosen so that a positive but smooth opening action results. The rate of opening is determined by the rates of the twin hydraulic dampers 46, 48. One of the main girder structures opens faster than the other, sb preventing the structures from interfering with each other as they rotate about their respective pivots.

Figure 4:
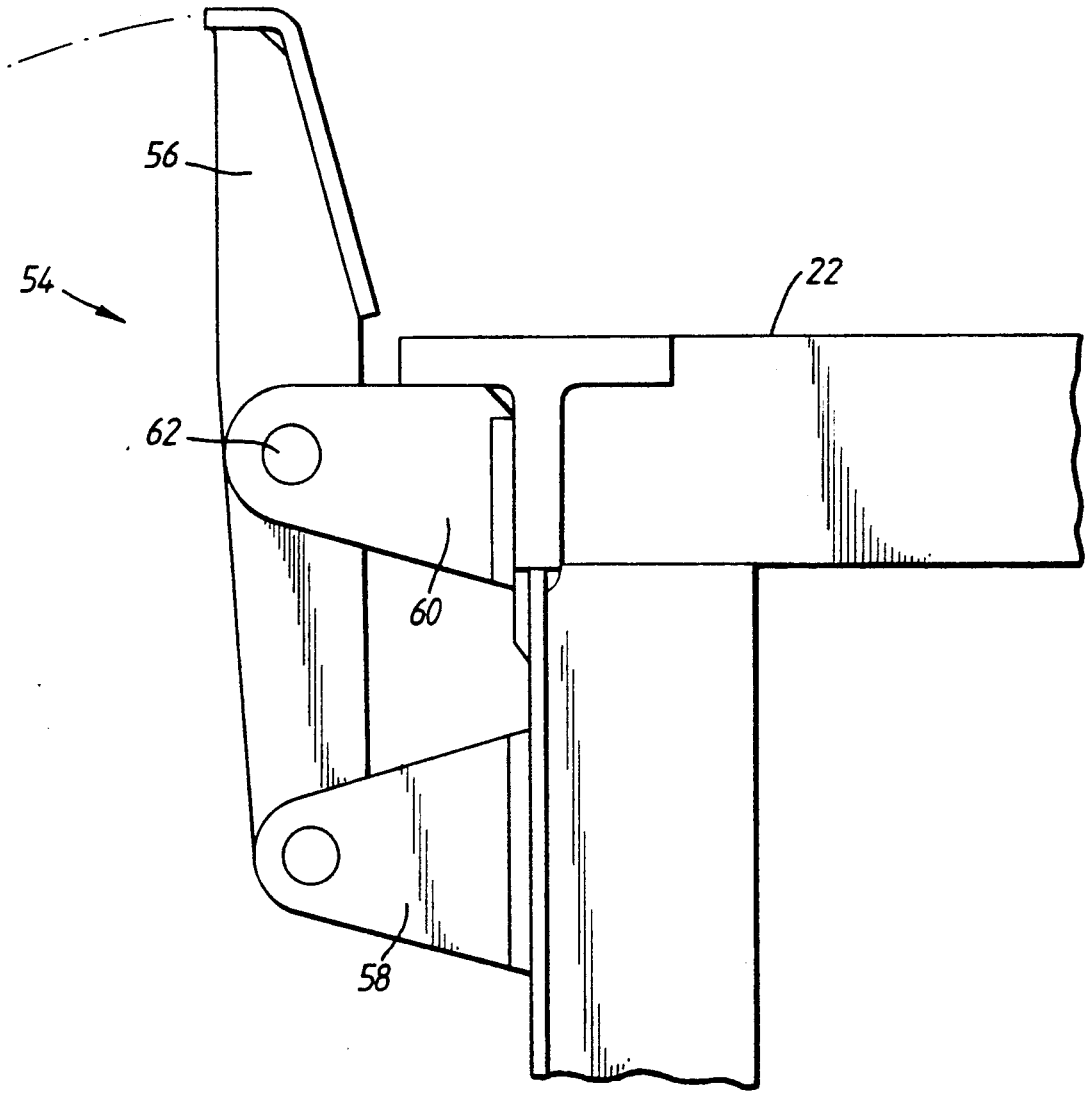
FIG. 4 shows a detail of the roadway curb.
Figure 5:
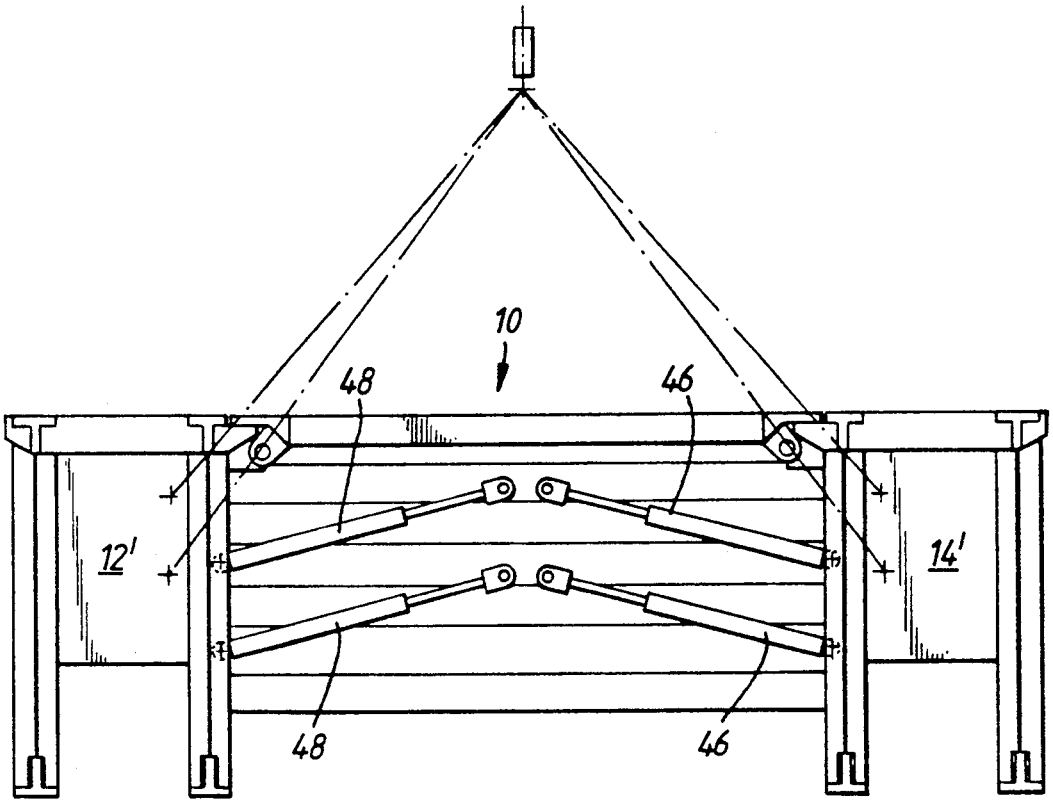
FIG. 5 is an end elevation of a ramped bridge module embodying the present invention.
Figure 6:
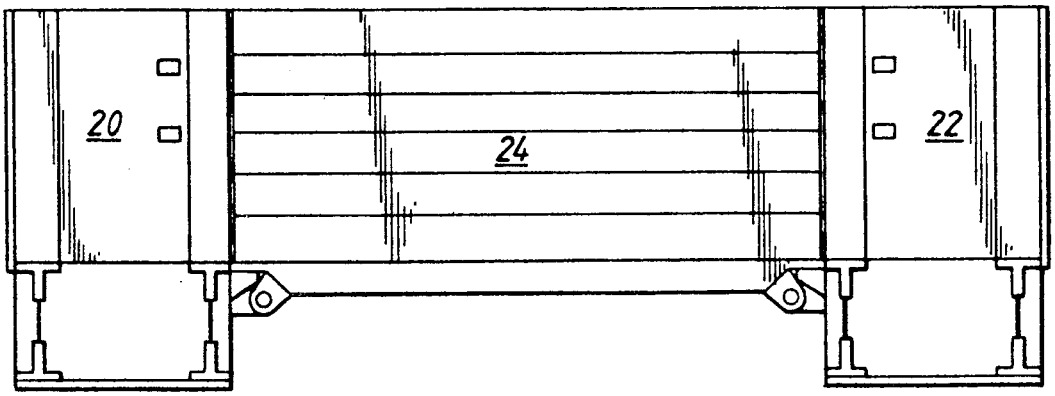
FIG. 6 is the other end elevation corresponding to that of FIG. 5.

Reference will now be made to FIG. 4 in conjunction with FIGS. 2 and 3, to describe a deck curb generally illustrated at 54. In the use position of the module, the curb 54 consists of an elongate curb member 56 which extends upwardly at the lateral edge of the deck surface 22. The curb member is pivoted at its lower end to an attachment 58 extending from the supporting girder 30 and is held in that position by being pinned to a further attachment 60 at the top of the girder.

To save space when the module is in the folded position shown in FIG. 2, the curb member 56 can be moved to a stored position as shown. A locking pin 62 is removed, freeing the curb member from the attachment 60, and allowing it to pivot downwardly to its stored position. In this position, it can be locked by means of a further locking pin to an additional attachment 64. In this way, as may clearly be seen in FIG. 2, the entire envelope of the folded module, including the curb, is only four feet in height and eight feet in width. This allows two such modules to be stacked, one on top of the other, within a standard ISO container.

A further embodiment of the present invention is shown in FIGS. 5 to 10. This embodiment is similar to the embodiment of FIGS. 1 to 3 and consequently will not be described in any great detail. Suffice it to say that the embodiment of FIGS. 5 to 10 is a ramped bridge module, that is a module having a sloping deck surface. One of these such modules will be used at each end of the bridge to provide a sloping ramp to enable vehicles to drive onto and off of the bridge.

The main difference between the first embodiment and the second embodiment is that, in the second, the lateral main girder structures 12', 14' have ramped upper deck surfaces, 20, 22. Similarly, the central deck structure 10 has a ramped central deck 24.

The main consequence of this is that the securing points of the recovery sling and the deployment sling have to be positioned slightly differently. Similarly, the dampers are positioned slightly differently.

Figure 8:
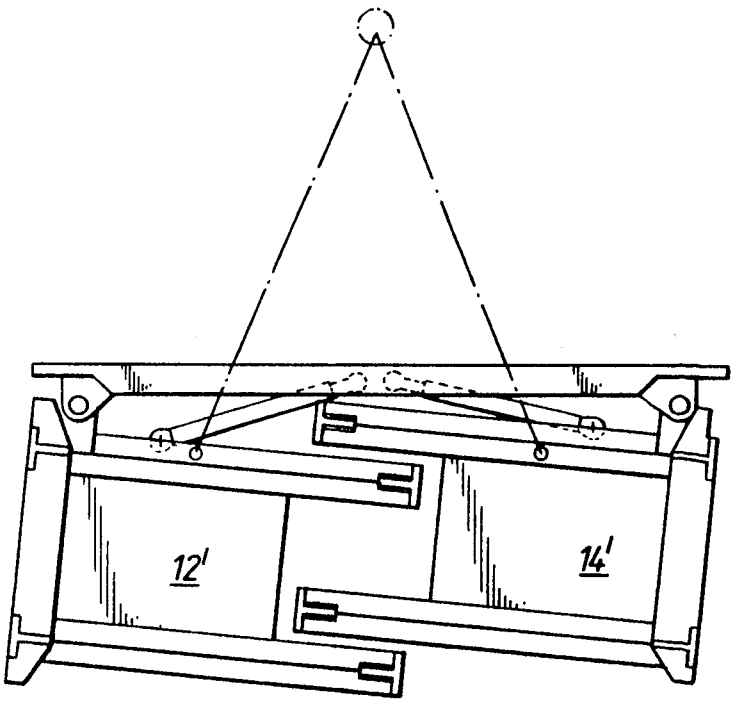
FIG. 8 is an end elevation, in the same direction as FIG. 5, showing the module in its folded state.
Figure 7:
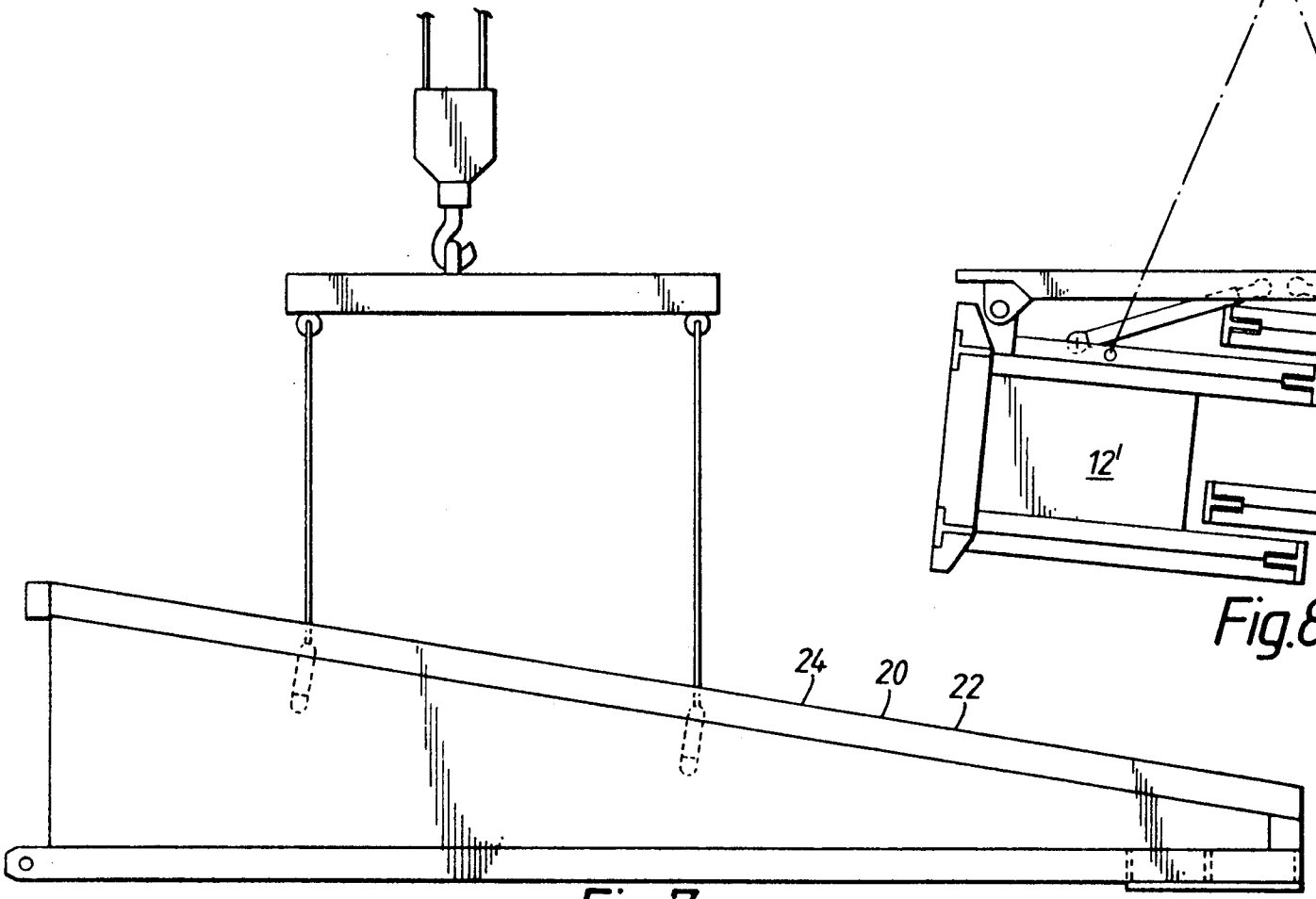
FIG. 7 is a side elevation of the bridge module of FIG. 5
Figure 9:
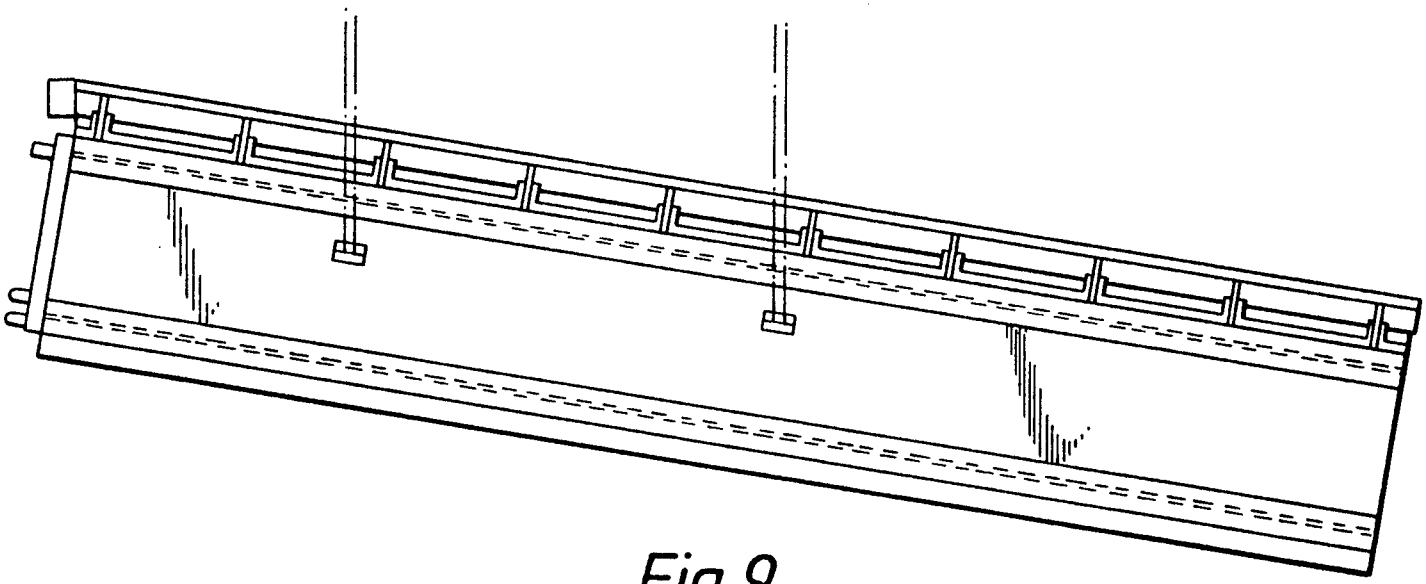
FIG. 9 is a side elevation of the modules shown in FIG. 8.
Figure 10:
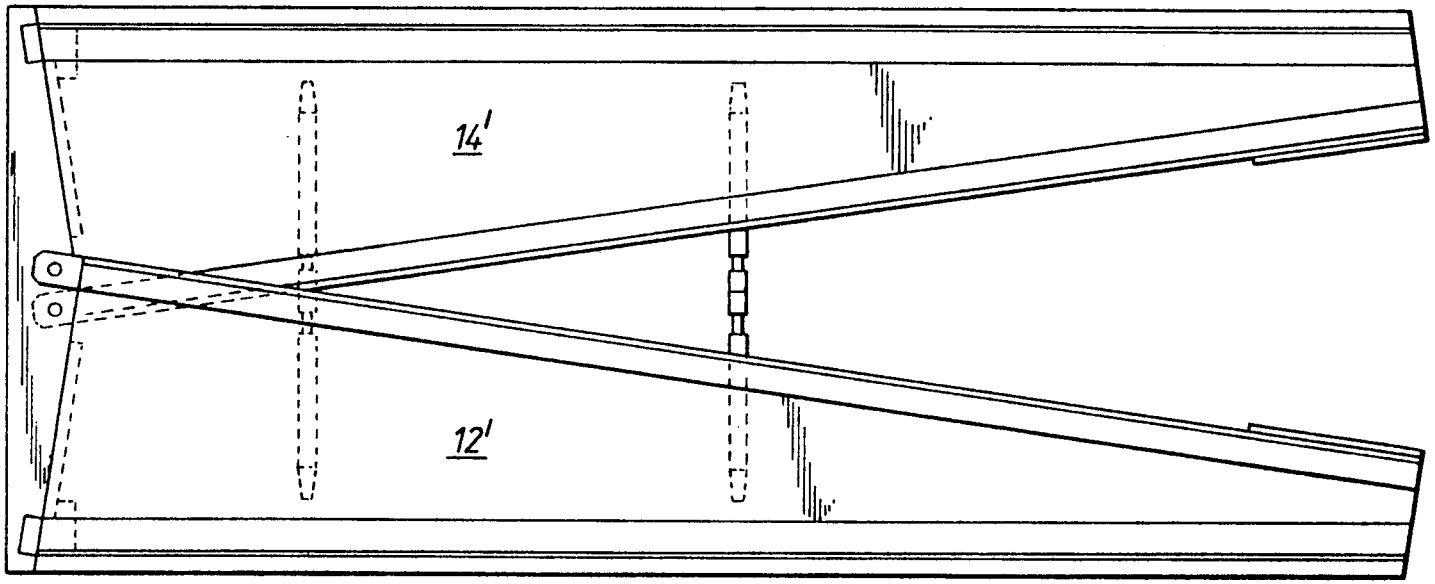
FIG. 10 is an underneath view of the module shown in FIG. 8.

In the folded position of the bridge, as is clearly shown in FIGS. 8 and 10, the fact that the main girder structures taper means that they will intermesh only at one end of the module.

Thus, it can be seen that a modular bridge is disclosed wherein each girder structure may include or consist of one or more downwardly-extending support girders which are rotatable about their respective pivots from the use position, in which they extend generally vertically, to the storage position. In the storage position, the girders overlie, overlap, mesh or nest with each other. In a particularly convenient embodiment, each lateral girder structure comprises first and second downwardly-extending girders, webs or walls, preferably parallel to each other, between which is a lateral deck structure defining the lateral deck. With this type of arrangement, when the main girder structures are in their storage position, they mesh with one another. In other words, the first girder of one girder structure is received between the first and second girders of the other structure; and the second girder of the other structure is received between the first and second girders of the said one structure.

The spacing between the first and second girders of each structure is chosen so that the respective first and second girders abut each other, and the respective second and first girder also abut each other in the storage position. The spacing may be determined so that the abutment occurs when one of the girder structures has rotated about its pivot through slightly more than 90° (for example 95°) and the other has rotated through slightly less than 90° (for example 85°).

The opposing sides of the girders may be provided with rubbing or sliding strips or surfaces to prevent the module from seizing should the girders of one structure rub against the girders of the other.

The central deck structure conveniently comprises a deck surface, suitable for carrying traffic. Loads applied to this central deck surface may be transferred into the lateral main girder structures by means of lips on the lateral edges of the central deck which rest upon corresponding shoulders of the girder structures. This avoids the loads being carried by the pins on which the girder structures are pivoted to the central deck structure. It is not, however, essential for the central support to be capable of carrying traffic, or indeed to provide a deck of any sort. It could, for example, instead simply consist of a plurality of horizontal spars. In that event, the bride would of course only be able to take vehicles having wheels or tracks which are spaced suitably to rest one on each lateral deck surface of the lateral girder structures.

At the lateral edges of the lateral decks there may be curbs to define the edge of the roadway. Each curb may comprise an elongate curb member hinged to the lateral deck structure for movement between a first position in which extends upwardly of the corresponding lateral deck surface, and a second position in which it is beneath the deck surface. Securing means, for example locking pins, may be provided for locking the curb in each of these two positions. When the curbs are hingeable in this way they can be tucked neatly out of the way when the module is in the storage position.

The bridge module of the present invention may be either a parallel or a ramped module. The invention also extends to a modular bridge, including one or more bridge modules as previously defined.

According to a second aspect of the present invention there is provided a bridge module comprising a central support defining a centre deck and first and second lateral girder structures respectively pivotally mounted to the support for movement between a use position in which the girder structures provide respective deck surfaces laterally of the centre deck, and a storage position beneath the deck, characterized in that each girder structure includes a pair of parallel support girders, the support girders of the two girder structures intermeshing with each other when the when the girder structures are in the storage position.

I claim:

1. A bridge module comprising a central support and first and second lateral girder structures respectively pivotally mounted to the support for movement between a use position in which the girder structures are located substantially to each side of the central support and provide respective deck surfaces laterally of the support, and a storage position in which the lateral girder structures are rotated into a folded state beneath the support, wherein the lateral girder structures in the storage position each extend more than half way across the width of the central support and thus at least partially overlap each other when viewed in a direction perpendicular to the plane of the deck surfaces in the use position, characterized in that the module includes mechanical means operably coupled to the lateral girder structures for damping the movement of the lateral girder structures between the storage and use positions, the degree of damping being different for each of the first and second lateral girder structures.

2. A bridge module as defined in claim 1 in which the lateral girder structures each include portions which in the use position extend downwardly, at least one of which portions on one of the said first and second lateral girder structures extends in the storage position between two said portions on the other said lateral girder structure.

3. A bridge module as defined in claim 1 having an overall height which is less than twice the height of each lateral girder structure.

4. A bridge module as defined in claim 1 in which each lateral girder structure comprises first and second girder which extend downwardly, between which girders is a lateral deck structure defining the lateral deck on each lateral girder structure.

5. A bridge module is defined in claim 4 in which the storage position the first girder of each lateral girder structure is received between the first and second girders of the other lateral girder structure.

6. A bridge module as defined in claim 5 in which the said damping means comprises a pair of hydraulic dampers, one of which extends between the central support and the first lateral girder structure; the other, having a different rate, extending between the central support and the second lateral girder structure.

7. A bridge module as defined in claim 2 having an overall height which is less than twice the height of each lateral girder structure.

8. A bridge module as defined in claim 7 in which each lateral girder structure comprises first and second girders which extend downwardly, between which girders is a lateral deck structure defining the lateral deck on each lateral girder structure.

9. A bridge module as defined in claim 8 in which in the storage position the first lateral girder of each structure is received between the first and second lateral girder girders of the other lateral girder structure.

10. A bridge module as defined in claim 9 in which said damping means comprises a pair of hydraulic dampers, one of which extends between the central support and the first lateral girder structure; the other, having a different rate, extending between the central support and the second lateral girder structure.

11. A bridge module as defined in claim 2 in which each lateral girder structure comprises first and second girders which extend downwardly, between which girders is a lateral deck structure defining the lateral deck on each lateral girder structure.

12. A bridge module as defined in claim 11 in which the storage position the first girder of each lateral girder structure is received between the first and second girders of the other lateral girder structure.

13. A bridge module as defined in claim 4 in the storage position in which the first lateral girder girder of each structure is received between the first and second girders of the other lateral girder structure.

14. A bridge module as defined in claim 13 in which said damping means comprises a pair of hydraulic dampers, one of which extends between the central support and the first lateral girder structure; the other, having a different rate, extending between the central support and the second lateral girder structure.

15. A bridge module comprising:

a central support defining a center deck;

first and second lateral girder structures respectively pivotally mounted to the support for movement between a use position in which the lateral girder structures are located substantially entirely to each side of the central support and provide respective deck surfaces laterally of the center deck, and a storage position in which the lateral girder structures are rotated into a folded state beneath the center deck, wherein each lateral girder structure includes a pair of parallel support girders, at least one of the support girders of one of the said first and second lateral girder structures being received between the support girders of the other said lateral girder structure when the lateral girder structures are in the storage position; and a respective damping mechanism operably coupled to each of said first and second lateral girder structures wherein the degree of damping provided by said first and second damping means is different whereby said lateral girder structures fold at different rates.

16. A bridge module comprising:

a central support;

first and second lateral girder structures respectively pivotally mounted to the support for movement between a use position in which the lateral girder structures are located substantially to each side of the central support and provide respective deck surfaces laterally of the support, and a storage position in which the lateral girder structures are rotated into a folded state beneath the support, wherein the lateral girder structures in the storage position each extend more than half way across the width of the central support, and thus at least partially overlap each other when viewed in a direction perpendicular to the plane of the deck surfaces in the use position;

a first damping mechanism coupled to at least one of said first lateral girder structure and said central support for damping the movement of the first lateral girder structure between said storage and use positions; and a second damping mechanism coupled to at least one of said second lateral girder structure and said central support for damping the movement of the second lateral girder structure between the storage and use positions, wherein the degree of damping of said first and second damping mechanisms is different.

17. The bridge module as defined in claim 16, wherein said first damping mechanism includes a hydraulic damper.

18. The bridge module as defined in claim 16, wherein said second damping mechanism included a hydraulic damper.

* * * * *

UNITED STATES PATENT AND TRADEMARK OFFICE

CERTIFICATE OF CORRECTION

PATENT NO. : 5,307,533
DATED : May 3, 1994
INVENTOR(S) : Thomas S. Parramore

It is certified that error appears in the above-indentified patent and that said Letters Patent is hereby corrected as shown below:

Column 4, line 23;

"sb" should be –so–.

Column 5, line 44;

"bride" should be--bridge--.

Column 6, line 40;

"girder" should be –girders–.

Column 6, line 43;

After "which" insert –in–.

Column 6, line 64, claim 9;

Before "girders" delete –girder–.

Column 7, line 13, claim 13;

After "girder" delete second occurrence of -girder–.

Column 8, line 38, claim 18;

"included" should be –includes–.

Signed and Sealed this

Twenty-second Day of November, 1994

*Attest:*

Bruce Lehman

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,307,533

DATED : May 3, 1994

INVENTOR(S) : Thomas S. Parramore

It is certified that error appears in the above-indentified patent and that said Letters Patent is hereby corrected as shown below:

On the title page, [30] Foreign Application Priority Data; "Jul. 1, 1991" should be —Jan. 7, 1991—.

Signed and Sealed this

Twenty-first Day of March, 1995

*Attest:*

Bruce Lehman

BRUCE LEHMAN

*Attesting Officer*

*Commissioner of Patents and Trademarks*